US005452637A

United States Patent [19]

DeCola

[11] Patent Number: 5,452,637

[45] Date of Patent: Sep. 26, 1995

[54] GUITAR WITH REINFORCED NECK JOINT AND CONTOURED HEEL

[75] Inventor: James B. DeCola, Meridian, Miss.

[73] Assignee: Peavey Electronics Corporation, Meridian, Miss.

[21] Appl. No.: 323,613

[22] Filed: Oct. 17, 1994

[51] Int. Cl.[6] ..... G10D 1/08; G10D 3/00

[52] U.S. Cl. ..... 84/291; 84/293; 84/267

[58] Field of Search ..... 84/291, 292, 293, 84/267, 268, 269; D 17/14

[56] References Cited

U.S. PATENT DOCUMENTS 4,856,403 8/1989 Davies ..... 84/293

4,939,970 7/1990 Hoshino et al. ..... 84/293

*Primary Examiner*—Steven L. Stephan
*Assistant Examiner*—Cassandra Spyrou
*Attorney, Agent, or Firm*—Watson, Cole, Grindle & Watson

[57] ABSTRACT

The guitar is formed with a guitar body, a neck and a connector securing the neck and body together. The body and the connector have trailing edge portions which lie at an angle to the guitar axis and sweep rearwardly for providing a contoured area behind the neck to thereby facilitate access to the higher fret notes. In one embodiment, the connector is an extruded aluminum member having an upwardly projecting neck flange that is visible from the front adding a decorative effect.

12 Claims, 5 Drawing Sheets

15
42
d
50
20
27
15
25
27
16
θ
24
22
34
29
14
15
12
18
θ
30

GUITAR WITH REINFORCED NECK JOINT AND CONTOURED HEEL

BACKGROUND OF THE INVENTION

The invention relates to stringed instruments and in particular to a stringed instrument such as a guitar having a reinforced neck joint for extra strength and rigidity, and a contoured heel for rendering higher frets more easily accessible and thereby facilitating playability of the instrument.

Various methods for fastening the neck to the body of a guitar are known. For example, the neck may be attached to the front or the back of the guitar body by a glue joint or by means of screws. In either case, the combined thickness of the neck and guitar body makes it difficult to reach the higher frets located at the base or proximal end of the neck. For example, design patent DES 164,227 illustrates a conventional guitar having a neck attached to the front of the guitar body by means of screws passing through the heel portion which overlaps the neck. U.S. Pat. No. 4,939,970 discloses a conventional guitar which employs a connector for joining the neck to the body. The guitar body has a heel which also overlaps the base of the neck. U.S. Pat. No. 4,896,578 discloses a neck and body assembly for a stringed instrument in which a connecting flange of reduced thickness at the base of the neck is received within a cavity in the guitar body. Although accessibility to the higher frets is somewhat improved, the thickness of the neck and body is greater than is desirable for comfortable playing.

It is also important to provide a durable and rigid connection between the neck and the body. At the same time, it is desirable to provide a smooth and aesthetically pleasing connection. Unfortunately, the forces on the body and neck of a stringed instrument, and in particular a guitar, sometimes requires a tradeoff between aesthetics and strength. It is therefore desirable to provide a stringed instrument, and in particular a guitar, which has a heel portion contoured to facilitate ease of play. At the same time, it is desirable to have a neck joint which although contoured, is rigid and durable and at the same time aesthetically pleasing.

SUMMARY OF THE INVENTION

The present invention is based upon the discovery that a neck joint reinforcement, in the form of a connector between the body and the neck, allows the body of the guitar to be produced with a contoured heel, thereby facilitating access to the higher frets, while at the same time providing a rigid and durable connection which results in an aesthetically pleasing neck joint.

In a particular embodiment, the invention is directed to a guitar comprising a guitar body having an axis and a pocket formed in the front side, a neck having a proximal end adapted to engage the body in the pocket along the axis, and a connector for connecting the body and the neck. The connector has a neck end portion, a body end portion and a intermediate neck flange. The neck end portion and neck flange are adapted to respectively engage the rear side and base or distal end of the neck. The body end portion is adapted to engage the front of the guitar body in the pocket. The neck end portion has a distal end disposed at an angle relative to the neck axis. The neck flange lies perpendicular to the neck end portion and is transverse to the neck axis. The guitar body has a heel portion which is contoured to lie generally parallel to the distal end of the connector thereby reducing the thickness of the heel near the base end of the neck.

In one embodiment, the connector is in the form of an extruded aluminum offset "T" in which the body end of the connector and the intermediate neck flange are formed with an integral inside fillet and the neck end portion is offset in a plane parallel to the body end portion.

The body end portion abuts an interior surface of the body and a pair of screws are employed to attach the guitar body and the body end portion of the connector together through apertures formed in a rear side of the body aligned with corresponding threaded apertures in the body end portion. The neck end portion is secured to the rear side of the neck near the base end thereof by means of fasteners passing through apertures in the neck end portion and extending into the neck. The base end of the neck is secured to the neck flange by means of fasteners passing through the apertures in the neck end flange and into the neck in alignment with the axis of the guitar.

DESCRIPTION OF THE INVENTION

Figure 1:
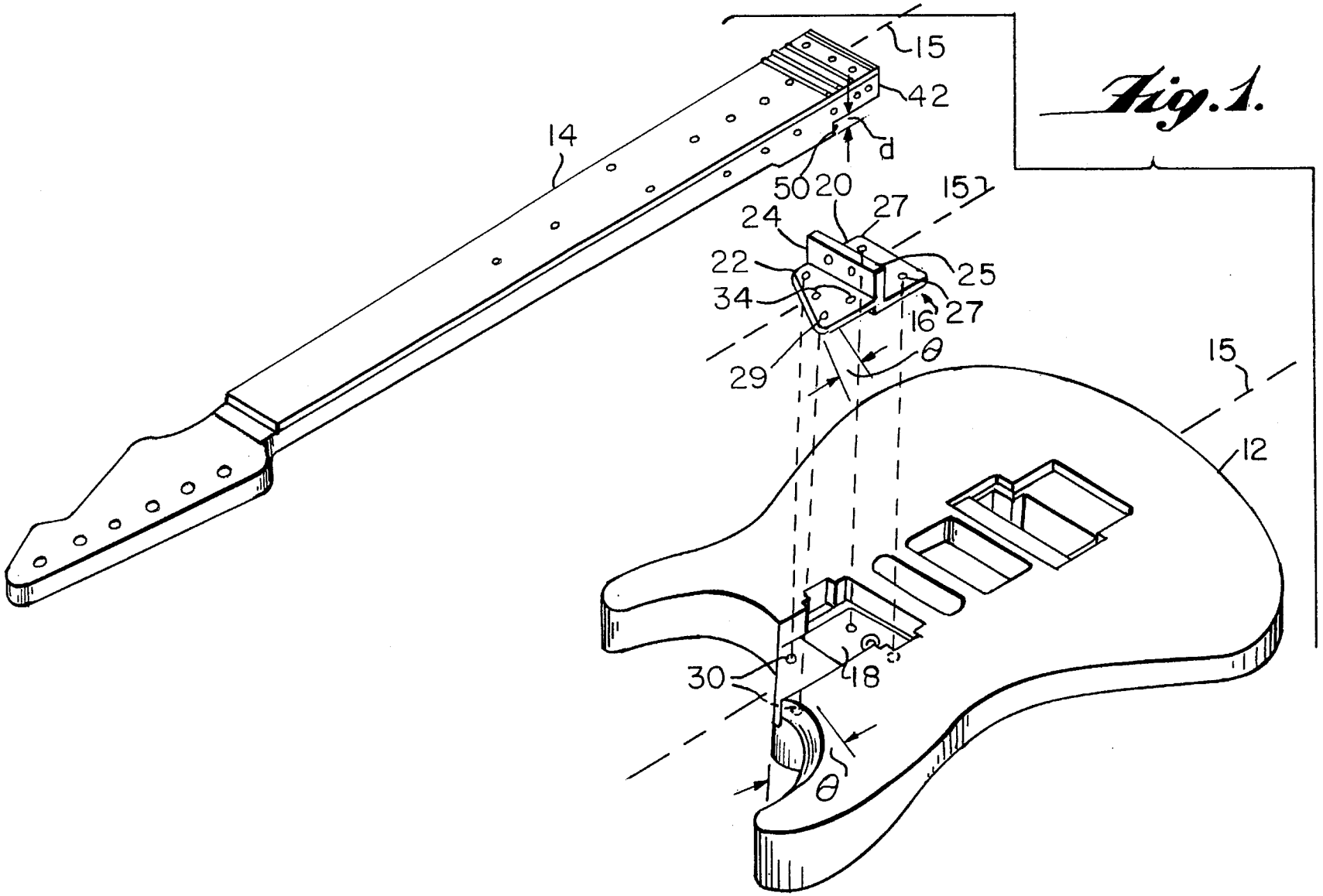
FIG. 1 is an exploded perspective view of the guitar according to the present invention.
Figure 2:
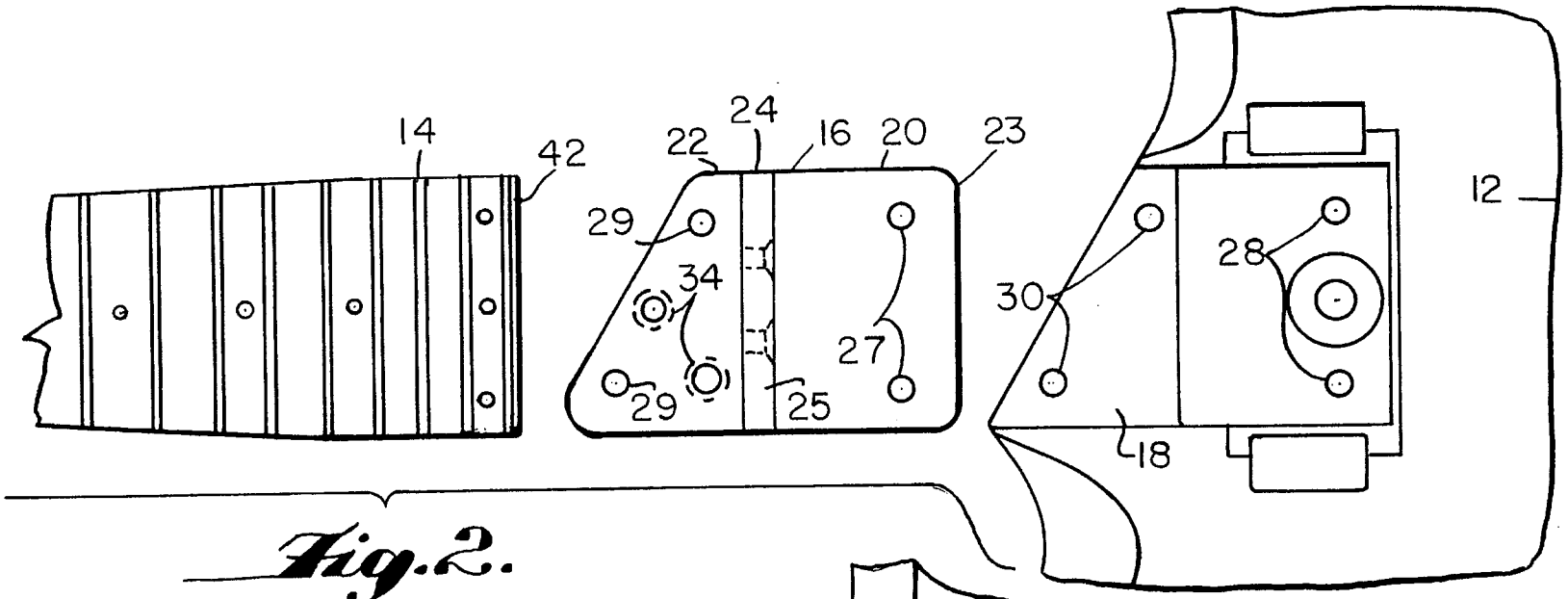
FIG. 2 is an exploded fragmentary top plan view of the guitar illustrated in FIG. 1.

The invention is directed to an assembly for a stringed instrument, such as an electric guitar 10 illustrated in FIGS. 1–6. The guitar 10 includes a body 12, a neck 14, and a connector 16 for securing the body 12 and neck 14 together aligned along a guitar axis 15. Strings, frets, electronics and other mechanical elements of an electric guitar are not shown but are well-known in the art.

The guitar body 12 has a decorative shape, as illustrated, and is typically fabricated from a solid block of wood or other suitable material. According to the invention, the body 12 is formed with a pocket 18 for receiving a portion of the neck 14 and connector 16 as hereinafter described. According to the invention, the connector 16 is attached to the neck 14 and the combined neck and connector assembly is attached to the body as illustrated in the fragmentary top assembly illustrated in FIG. 4.

The connector 16 illustrated in FIGS. 7A–7G, comprises in an exemplary embodiment a piece of extruded aluminum having the shape of an offset T with an inside fillet 19. The connector 16 comprises a body end portion 20, a neck end portion 22 and an intermediate neck flange 24 each having a thickness t. Varying thickness may be employed if desired.

Figure 7A:
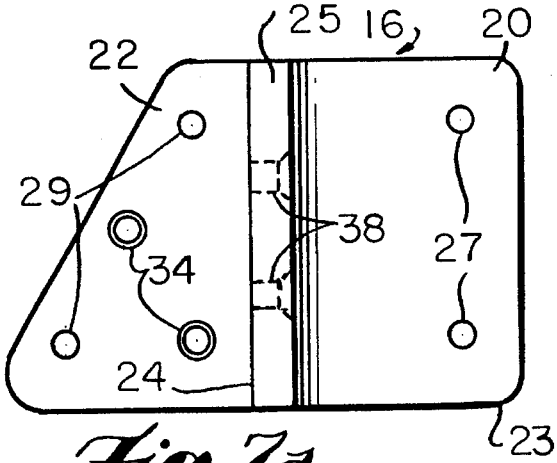
FIGS. 7A–7G are respective top, upper and lower sides, body end and neck end, bottom and perspective views of the connector which forms a portion of the guitar illustrated in FIG. 1.
Figure 7D:
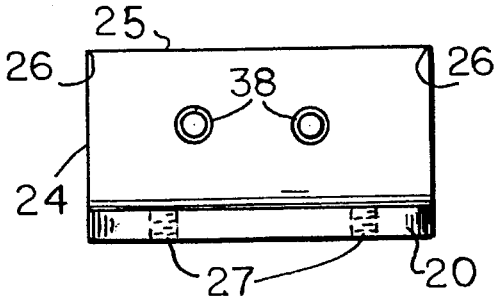
Figure 7B:
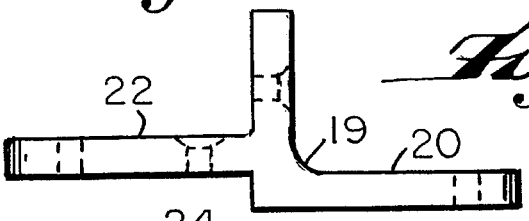
Figure 7C:
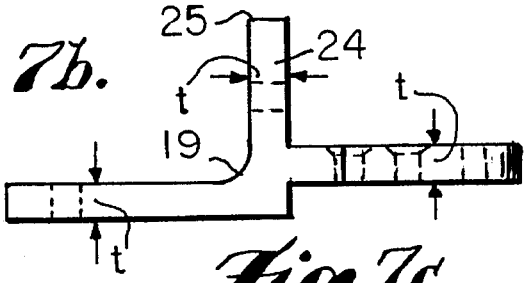
Figure 7F:
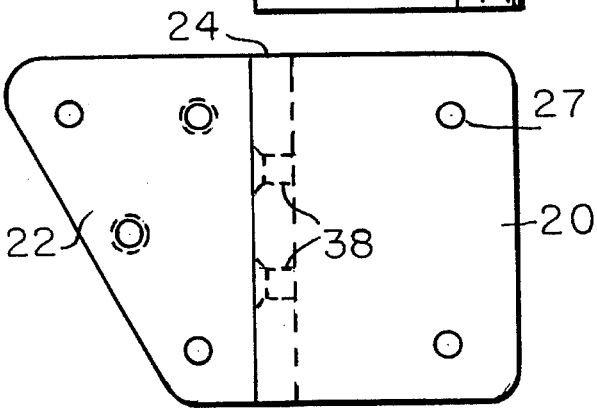
Figure 7E:
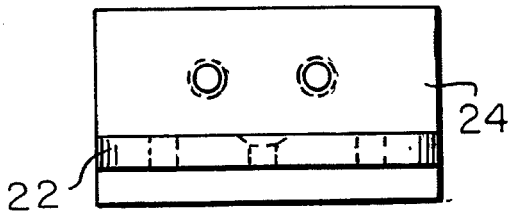
Figure 7G:
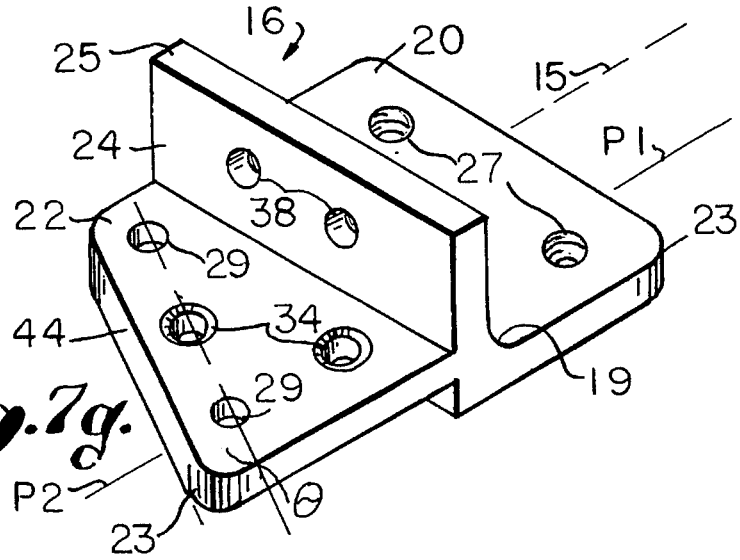

In the arrangement illustrated, the body end portion 20 and neck end portion 22 generally lie in offset parallel planes P1–P2 and may have rounded corners 23, as shown. The neck flange 24 has a height h and lies in a plane P3 perpendicular to the axis 15 and the planes P1 and P2 (FIG. 7G). The flange 24 has a decorative face 25 and generally square corners 26.

Figure 3:
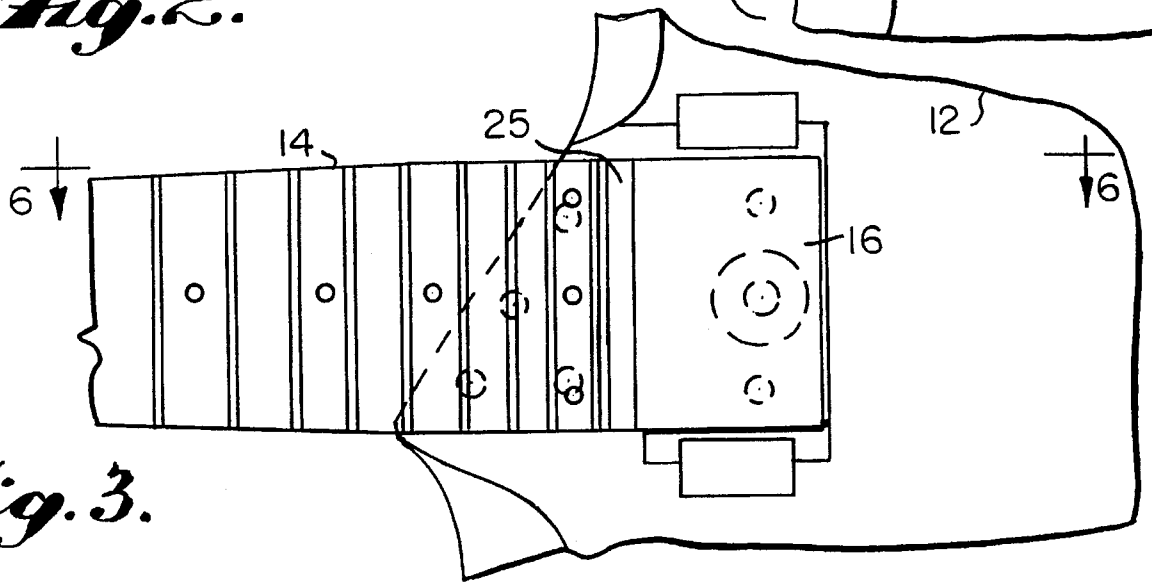
FIG. 3 is a fragmentary top plan view of the guitar illustrated in FIG. 1 with the parts assembled.

Referring to FIGS. 1, 3 and 7, the body end portion 20 has a plurality of threaded holes 27 which are in alignment with corresponding holes 28 in the guitar body 24 (FIG. 1). The neck end portion 22 is formed with a plurality of through holes 29 which are disposed at an angle θ relative to the guitar axis 15. The through holes 29 are in alignment with corresponding holes 30 in the body (FIG. 1) and holes 32 (FIG. 4) in the neck 14. The neck end portion 22 is also formed with through holes 34 set which are in alignment with holes 36 in the neck 14. The neck flange 24 is formed with holes 38 which are in alignment with holes 40 in the base end 42 of the neck 14. The holes 38 and 40 are generally aligned with the axis 15 of the guitar 10.

The connector 16 has a free end 44 which is disposed at about an angle θ relative to the axis 15 of the guitar 10. Likewise, the body 12 of the guitar 10 is formed with a contoured trailing edge 46 including a central portion which is generally parallel to the trailing edge 44 of the connector 16. The neck 14 is formed with a notch 50 cut to a depth d which is approximately the same as the thickness t of the neck end portion 22 and which has an interior edge 52 is adapted to be in abutment with the end 44 of the connector 16, as illustrated in FIG. 3. The base end 42 of the neck 14 has a thickness t1 which is approximately the same height h as the neck flange 24. Likewise, the thickness t of the neck flange 24 makes it visible when the guitar is assembled and provides an aesthetic and identifiable look for the guitar (FIG. 3).

Figure 5:
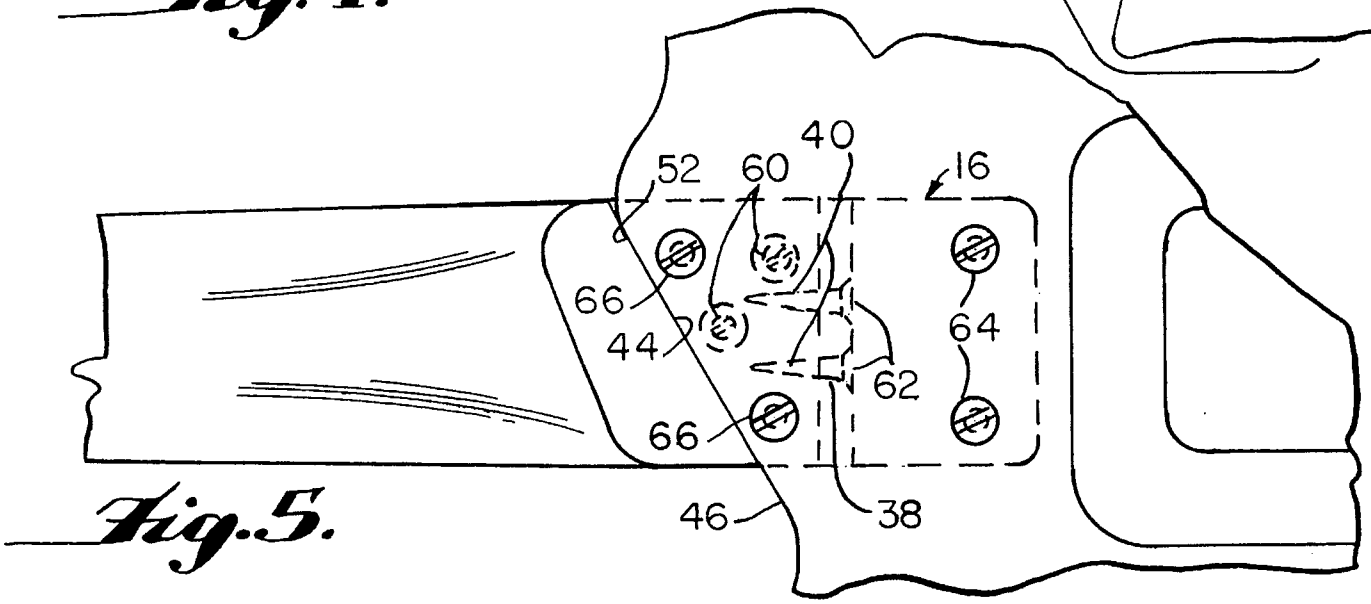
FIG. 5 is a fragmentary bottom plan view of the guitar illustrated in FIG. 1 with the parts assembled.

The guitar 10 is assembled as follows. The connector 16 is positioned in abutment with the base end 42 of the neck 14 and with the neck end portion 22 positioned within the notch 50 (FIG. 5). The connector 14 is attached to the neck 14 by means of wood screws 60 which engage the underside of the neck end portion 22 through the holes 34, as illustrated. The neck flange is also secured to the neck by screws 62 passing through holes 38 thus rigidly securing the connector 16 to the neck 14. The neck 14 and connector 16 assembly is then inserted in the pocket 18 and machine screws 64 engage the threaded holes 27 through the holes 28 in guitar body 12, as illustrated. Wood screws 66 passing through the holes 30 in the body and the holes 29 in the neck end portion 22 engage the neck 14 in the holes 32. Thus, the neck and connector assembly is rigidly secured to the body 12.

Figure 6:
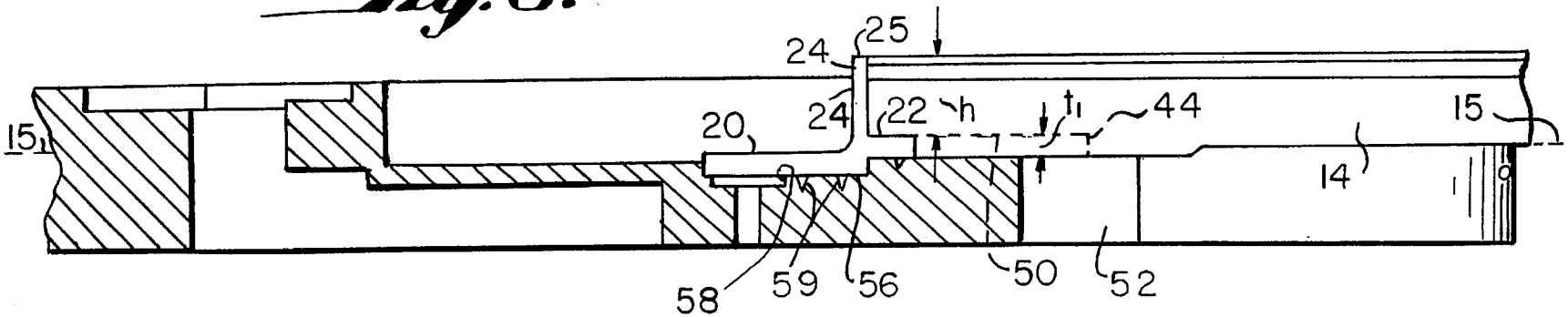
FIG. 6 is a fragmentary cross-section of the guitar taken along line 6—6 of FIG. 3.

As illustrated in FIGS. 1 and 6, the pocket 18 may be formed with an offset 56 profiled to match the corresponding offset between the body end portion 20 and neck end portion 22 thereby limiting axial motion of the neck 14 within the pocket 18 and providing a greater thickness in the body near the trailing edge 46 of the guitar body 12. If desired, a bottom surface 58 of the connector may be formed with saw tooth grooves 59 (shown in dotted line) or other protrusions, so that the grooves 58 bite into the confronting surface of the pocket 18. When the guitar is assembled the grooves 59 may thereby provide greater stability to the neck joint.

Figure 4:
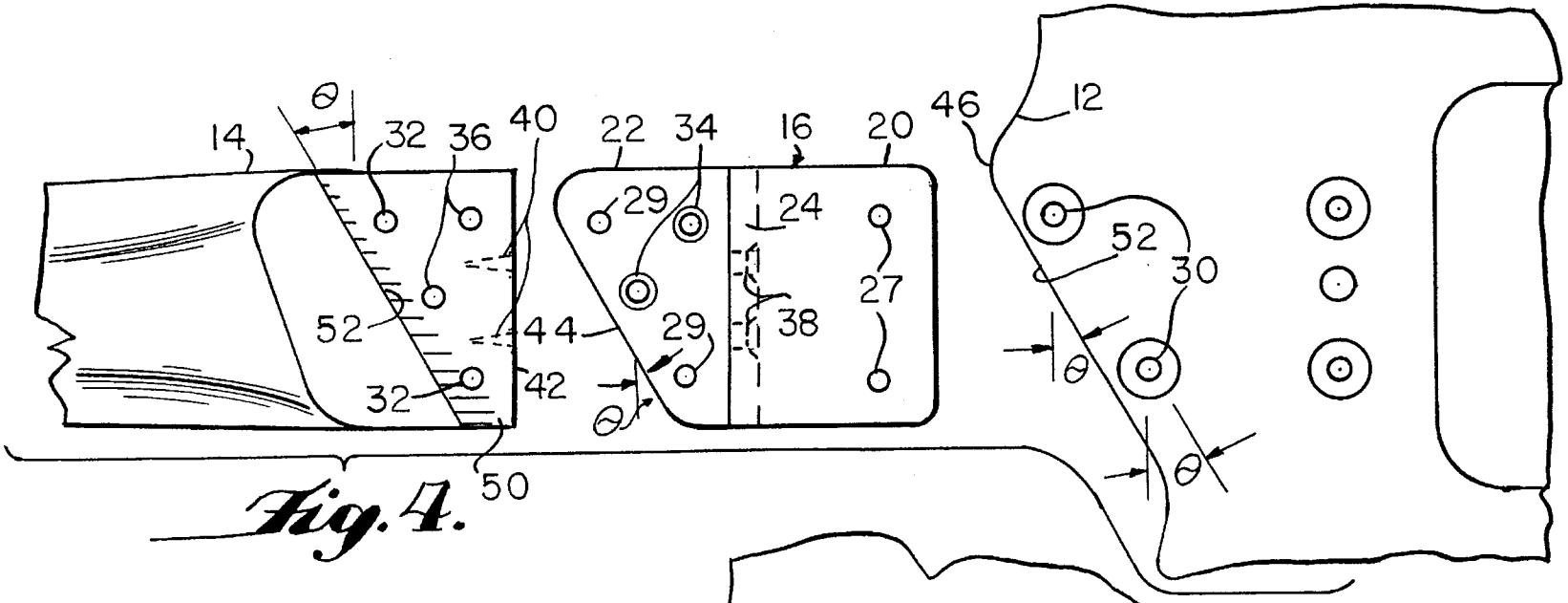
FIG. 4 is an exploded fragmentary bottom plan view of the guitar illustrated in FIG. 1.
Figure 9:
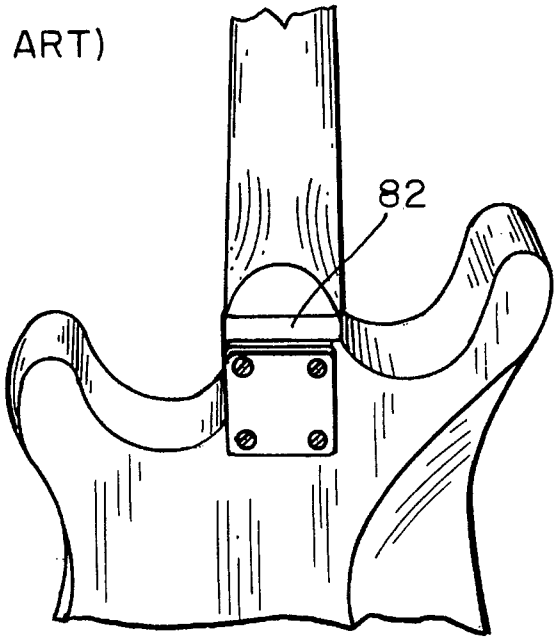
Fig. 9. (PRIOR ART)
FIG. 9 is a bottom perspective view of a conventional guitar.
Figure 8:
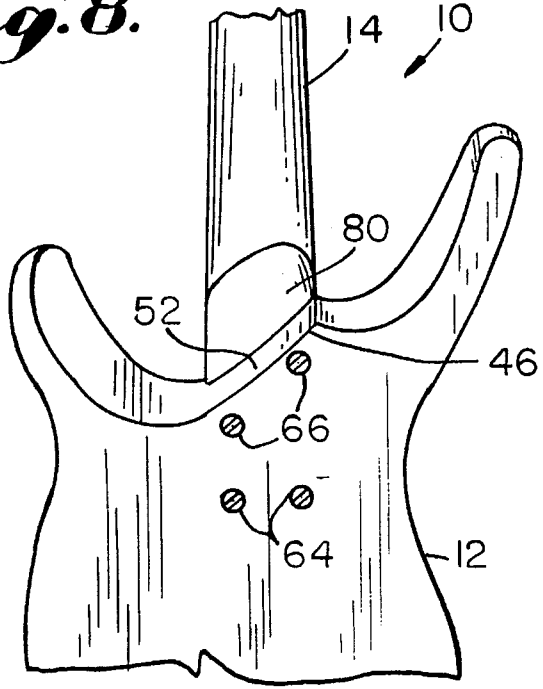
FIG. 8 is a bottom perspective view of the guitar according to the invention.

As illustrated in FIGS. 4 and 8, the neck 14 meets the guitar body 12 along the contoured trailing edge 46 and provides a contoured concave space 80 allowing additional room for the hand of the player, not shown, to grip the neck 14 and at the same time reach the highest frets near the base end 42. This is in contrast to the conventional design illustrated in FIGS. 9, in which the heel portion 82 of the guitar body extends axially along the neck thereby limiting access to the higher frets. The present invention provides for an angled connector 16 which in combination with the central trailing edge portion 46 of the body 12, makes available a concave contoured space 80 below the neck 14 so that the hand of the player can be positioned more closely to the base end and hence the higher frets on the neck. A heavy heel portion of conventional guitars limits access for the hand of the user. Such conventional guitars include those employing a metal connector between the neck and the body which have heretofore not provided a contoured space for the hand.

While there have been described what are at present considered to be the preferred embodiments of the present invention, it will be apparent to those skilled in the art that various changes and modifications may be made therein without departing from the invention, and it is intended in the appended claims to cover such changes and modifications as fall within the spirit and scope of the invention.

What is claimed is:

1. A neck joint for a guitar comprising:

a plate having a central axis, said plate including a neck end portion and a body end portion each having a corresponding proximal end and distal end and an intermediate neck flange interconnecting the proximal ends of the neck end portion and body end portion so that the distal ends are remotely spaced apart on the axis; the distal end of the neck end portion being disposed at an angle relative to the axis, and the neck flange being disposed transverse to the neck end portion, the body end portion and the axis.

2. A guitar comprising:

a guitar body having an axis and front side and rear side and a pocket formed in the front side thereof;

a neck having front and rear sides and a proximal end secured to the body along the axis;

a connector interconnecting the body and the neck;

the connector comprising a plate including a neck end portion, a body end portion and an intermediate neck flange; the neck end portion and neck flange secured to the rear side of the neck at the proximal end thereof, the pocket for receiving the connector and a portion of the neck therein; and the body end portion secured in the pocket to the front of the body, the neck end portion having a distal end disposed at an angle relative to the axis and the neck flange lying transverse to the neck end portion, the body end portion and to the axis; and the body having a reduced heel portion formed in the back side and extending at an angle generally parallel to the distal end of the connector.

3. The guitar of claim 2 wherein the reduced heel portion of the guitar body comprises a sweeping trailing edge adjacent to the proximal end of the neck and the distal end of the connector comprises a trailing edge portion lying at an angle relative to the guitar axis and generally parallel to a corresponding portion of the trailing edge of the guitar body so as to provide a contoured area behind the neck.

4. The guitar of claim 2 wherein the neck end portion and the body end portion lie in offset relationship in parallel planes and wherein the pocket within the body of the guitar is stepped for accommodating the connector in mating relationship.

5. The guitar of claim 2 further including first fastener means for securing the body end portion to the body, second fastener means for securing the neck end portion to the neck, third fastener means for securing the neck end portion to the body.

6. The guitar of claim 5 wherein the body end portion of the connector has a plurality of holes therein and the body has corresponding through holes therein in alignment with the holes in the connector.

7. The guitar of claim 6 wherein the holes in the connector are threaded.

8. The guitar of claim 5 wherein the neck end portion of the connector has a plurality of holes disposed at an angle relative to the axis of the guitar for receiving therein the second fastener means and the neck has holes therein for engagement with the second fastener means through a rear side of the neck end portion.

9. The guitar of claim 5 wherein the neck end portion of the connector has a plurality of holes disposed at an angle relative to the axis of the guitar and the body has corresponding through openings in alignment therewith, said third fastener means for engaging the neck through the openings in the body and the neck end portion.

10. The guitar of claim 5 including a top and bottom and wherein holes in the body and the holes in the neck end portion are disposed at an angle sweeping rearwardly of the guitar from the top to the bottom thereof.

11. The guitar of claim 2 wherein the neck flange extends forwardly of the body and lies adjacent the front side of the neck and is visible therefrom.

12. The guitar of claim 2 wherein the connector has a plurality of protrusions for engaging the body.

* * * * *